US007866181B2

(12) United States Patent
Lee et al.

(10) Patent No.: US 7,866,181 B2
(45) Date of Patent: Jan. 11, 2011

(54) REFRIGERATOR WITH ICE-MAKING UNIT

(75) Inventors: Jong Dal Lee, Gwangju (KR); Jae Hoon Lim, Suwon-si (KR); Myung Hoon Cho, Suwon-si (KR); Seung Tae Lim, Gwangju (KR); Dong Nyeol Ryu, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 261 days.

(21) Appl. No.: 11/878,598

(22) Filed: Jul. 25, 2007

(65) Prior Publication Data

US 2008/0041090 A1 Feb. 21, 2008

(30) Foreign Application Priority Data

Aug. 18, 2006 (KR) ..... 10-2006-0078427

(51) Int. Cl.
*F25C 5/18* (2006.01)

(52) U.S. Cl. ..... 62/344; 312/405.1; 292/DIG. 37; 292/DIG. 71

(58) Field of Classification Search ..... 62/344, 62/353

See application file for complete search history.

(56) References Cited

U.S. PATENT DOCUMENTS 4,186,978 A * 2/1980 Thomson ..... 312/321.5
5,341,542 A * 8/1994 Hannan et al. ..... 16/289
D549,745 S * 8/2007 Coulter et al. ..... D15/89
2004/0012314 A1* 1/2004 Hay et al. ..... 312/405.1
2006/0090496 A1 5/2006 Adamski et al.

* cited by examiner

*Primary Examiner*—Cheryl J Tyler
*Assistant Examiner*—Lakiya Rogers
(74) *Attorney, Agent, or Firm*—Staas & Halsey LLP

(57) ABSTRACT

Disclosed herein is a refrigerator having an ice-making unit wherein the coupling structure of a cover to open and close an ice-making compartment is improved such that a user can easily attach and detach the cover to and from the ice-making compartment. The refrigerator includes a refrigerator body having a refrigerating compartment and a freezing compartment defined therein, an ice-making compartment mounted at one side of the refrigerating compartment, the ice-making compartment having an opening formed at the front thereof, an ice-making compartment cover to open and close the opening of the ice-making compartment, a rotary lever mounted at the ice-making compartment cover, latching hooks rotatable along with the rotation of the rotary lever, and latching projections formed in a side wall of the ice-making compartment such that the latching hooks are coupled with the latching projections.

12 Claims, 5 Drawing Sheets

REFRIGERATOR WITH ICE-MAKING UNIT

CROSS-REFERENCE-TO RELATED APPLICATIONS

This application claims the benefit of Korean Patent Application No. 2006-78427, filed on Aug. 18, 2006 in the Korean Intellectual Property Office, the disclosure of which is incorporated herein by reference.

BACKGROUND

1. Field

The present invention relates to a refrigerator, and, more particularly, to a refrigerator having an ice-making unit.

2. Description of the Related Art

Generally, a refrigerator includes a freezing compartment and a refrigerating compartment, into which cool air, heat-exchanged by an evaporator, is introduced. Below the freezing compartment or the refrigerating compartment is located a machine compartment, in which a compressor and a condenser are mounted. The refrigerating of the refrigerator stores food at a temperature of approximately 3 to 5° C. such that the food is maintained in a fresh state. The freezing compartment of the refrigerator stores food at a sub-zero temperature for a long period of time such that the food is maintained in a frozen state.

Recently, there has been introduced a refrigerator constructed in a structure in which the refrigerating compartment is located at the upper part of the refrigerator to store water, other beverages, and food for a short period of time, and the freezing compartment is located at the lower part of the refrigerator, for user convenience. Also, the refrigerator includes an ice-making unit having a dispenser disposed at the front of a door of the refrigerator such that a user can conveniently take ice out.

An example of a conventional refrigerator is disclosed in U.S. Patent Publication No. US2006/0090496. The disclosed refrigerator is constructed in a structure in which a freezing compartment is located at the lower part of the refrigerator, a refrigerating compartment is located at the upper part of the refrigerator, and an ice-making compartment is located at the upper corner of the refrigerating compartment.

In the ice-making compartment are mounted an ice maker to make ice, a storage space to store the ice made by the ice maker, and a transferring unit to transfer the stored ice to the dispenser. To the open front of the ice-making compartment is assembled a cover, by which the ice-making compartment and the refrigerating compartment are partitioned from each other.

In the conventional refrigerator, however, when the cover, which opens and closes the open front of the ice-making compartment, is coupled to the front of a side wall of the ice-making compartment, the cover is assembled to the ice-making compartment in a forced fitting fashion due to the frictional force of a sealing member disposed along the inside edge of the cover, with the result that the coupling between the cover and the ice-making compartment may be incomplete.

Also, when the cover is coupled to the side wall of the ice-making compartment in a latching structure, it is required that a push button disposed at one side of the cover or the ice-making compartment be pushed to separate the cover from the ice-making compartment.

The operation of attaching to and detaching from the ice-making compartment is performed in a forward and rearward direction, whereas the operation of releasing the latched state between the cover and the side wall of the ice-making compartment is performed in the lateral direction. As a result, it is required that a user perform the two different operations to separate the cover from the ice-making compartment due to the inconformity in direction of the forces.

SUMMARY

Therefore, it is an aspect of the embodiments to provide a refrigerator wherein the coupling structure of a cover to open and close an ice-making compartment is improved such that a user can easily attach and detach the cover to and from the ice-making compartment.

Additional aspects and/or advantages will be set forth in part in the description which follows and, in part, will be apparent from the description, or may be learned by practice of the invention.

The foregoing and/or other aspects are achieved by providing a refrigerator including a refrigerator body having a refrigerating compartment and a freezing compartment defined therein, an ice-making compartment mounted at one side of the refrigerating compartment, the ice-making compartment having an opening formed at the front thereof, an ice-making compartment cover to open and close the opening of the ice-making compartment, a rotary lever mounted at the ice-making compartment cover, latching hooks rotatable along with the rotation of the rotary lever, and latching projections formed in a side wall of the ice-making compartment such that the latching hooks are coupled with the latching projections.

The latching hooks include a first latching hook mounted at one side of the ice-making compartment cover and a second latching hook mounted at the other side of the ice-making compartment cover, and the refrigerator further includes a rotary shaft connected between the first latching hook and the second latching hook such that the rotary shaft is rotated simultaneously with the rotation of the first latching hook and the second latching hook.

The refrigerator further includes an elastic member mounted at the ice-making compartment cover to elastically support the rotary lever such that the latching hooks are returned in the direction in which the latching hooks are coupled with the latching protrusions.

The rotary lever and the first latching hook may be integrally formed.

The latching hooks may be separated from the latching protrusions by pulling the rotary lever forward.

The latching hooks may be separated from the latching protrusions by pushing the rotary lever rearward.

The foregoing and/or other aspects are achieved by providing a refrigerator including an ice-making compartment mounted within a compartment of the refrigerator; an ice-making compartment cover covering an opening of the ice-making compartment; at least one latching hook attached to the cover; and at least one latching projection defined within a portion of the ice-making compartment, the at least one latching projection receiving the at least one latching hook in a latched state in which the hook is coupled to the projection.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF THE EMBODIMENTS

Figure 1:
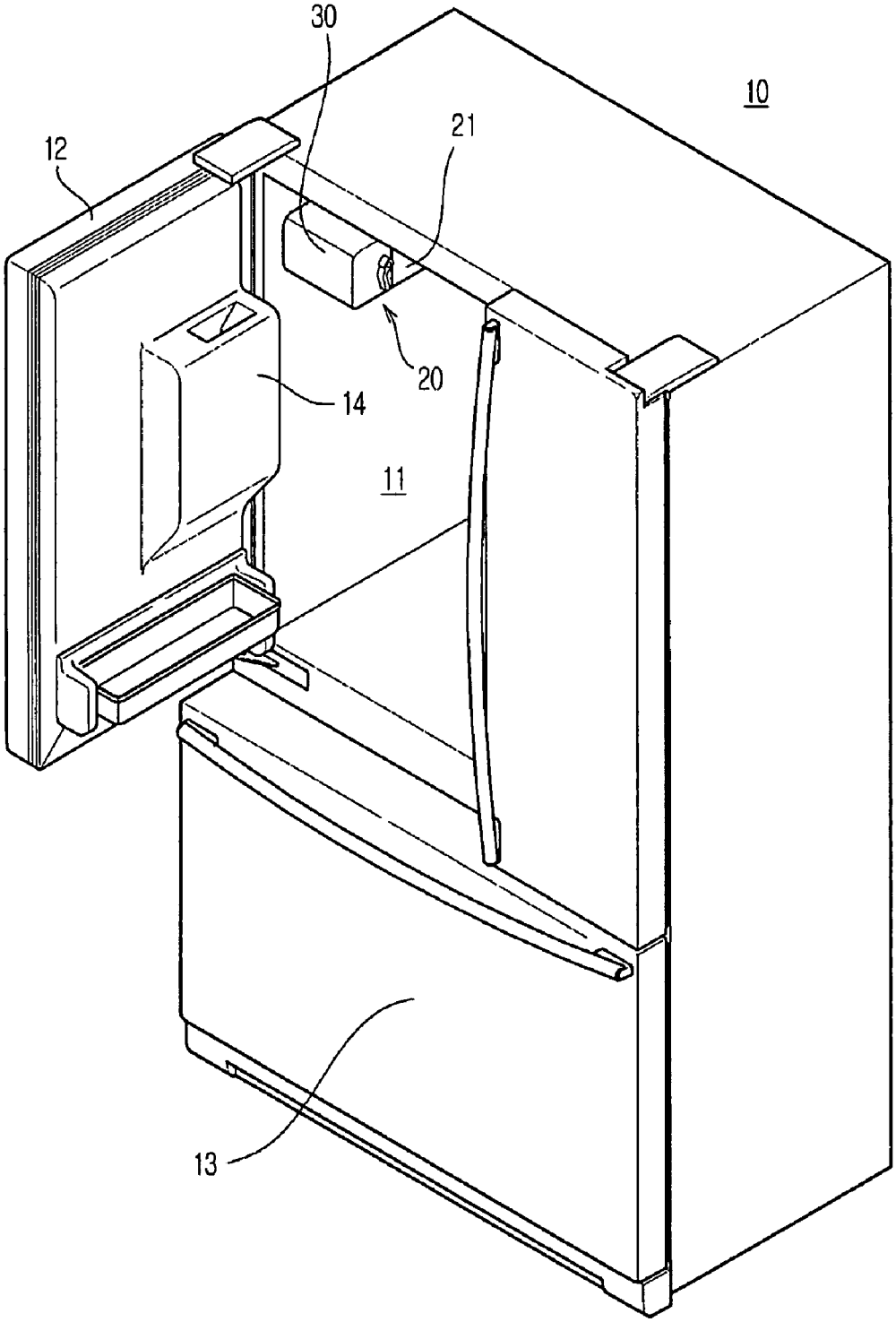
FIG. 1 is a perspective view illustrating the internal structure of a refrigerator according to a first embodiment of the present invention.

Reference will now be made in detail to the embodiments, examples of which are illustrated in the accompanying drawings, wherein like reference numerals refer to like elements throughout. The embodiments are described below to explain the present invention by referring to the figures.

A refrigerator according to the present embodiments is an apparatus to cool the interior of a storage compartment using a refrigeration cycle. Consequently, the refrigerator naturally includes a compressor, an evaporator, a condenser, and a decompression device, which constitutes the refrigeration cycle, and the detailed description of the refrigeration cycle will not be given.

FIG. 1 is a perspective view illustrating the internal structure of a refrigerator according to a first embodiment.

Referring to FIG. 1, a refrigerator body 10 is partitioned into two spaces. A refrigerating compartment 11 is formed in the upper space, and a freezing compartment is formed in the lower space.

To the open fronts of the refrigerating compartment 11 and the freezing compartment are connected doors 12 and 13 to open and close the refrigerating compartment 11 and the freezing compartment, respectively.

At one side of the refrigerating compartment 11 is mounted an ice-making unit 20 to make ice. The ice-making unit 20 is constructed such that the ice made by the ice-making unit 20 is discharged out of the refrigerator through a dispenser 14 mounted to the door 12 without opening the door 12.

Figure 2:
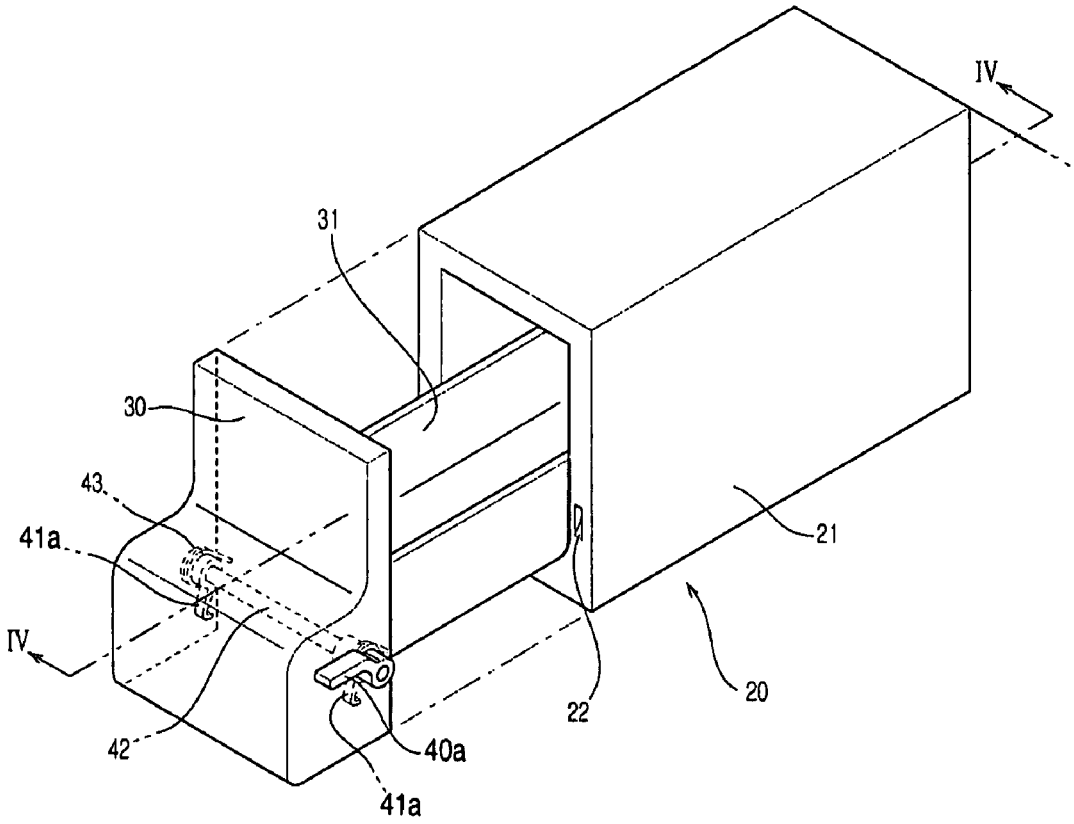
FIG. 2 is an exploded perspective view illustrating the construction of an ice-making unit according to the first embodiment of the present invention.
Figure 3:
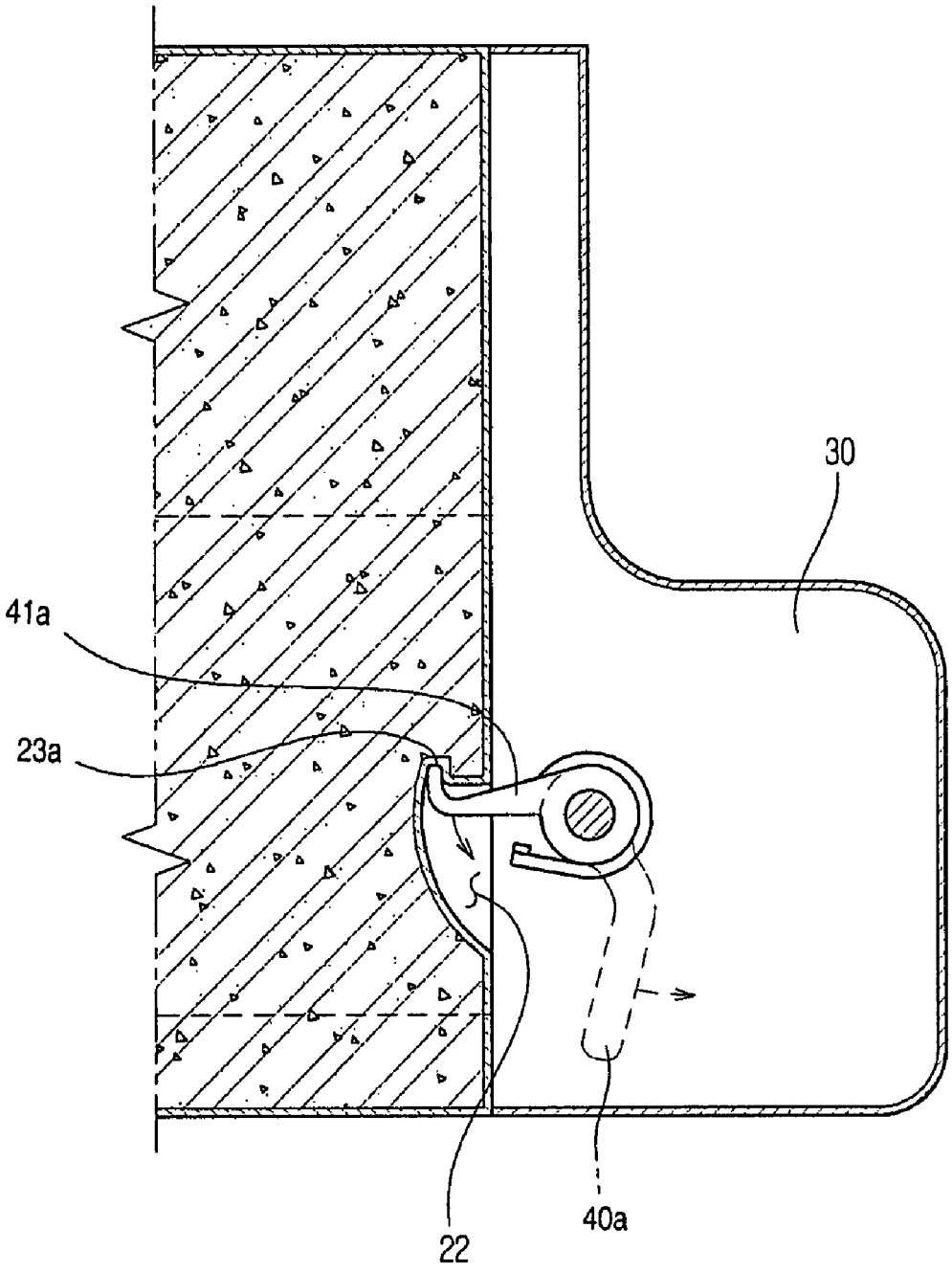
FIG. 3 is a sectional view taken along line IV-IV of FIG. 2.

FIG. 2 is an exploded perspective view illustrating the construction of an ice-making unit according to the first embodiment, and FIG. 3 is a sectional view taken along line IV-IV of FIG. 2.

Referring to FIGS. 2 and 3, the ice-making unit 20 includes an ice maker (not shown) to make ice in an ice-making compartment 21, including an insulating member, partitioned at one side of the interior of the refrigerating compartment 11, an ice bank (not shown) to store the made ice, and an auger 31 to transfer the ice stored in the ice bank to the front of the ice-making compartment.

The ice-making compartment 21 is provided at the front thereof with an opening, through which internal components of the ice-making compartment 21 are mounted in the ice-making compartment 21 and the internal components are separated from the ice-making compartment 21 to repair or clean the internal components of the ice-making compartment 21. At the front of the ice-making compartment 21 is mounted an ice-making compartment cover 30 to open and close the opening of the ice-making compartment 21 such that ice-making compartment 21 is partitioned from the refrigerating compartment.

In the bottom of the ice-making compartment cover 30 is formed an ice discharge port (not shown), which is connected to an inlet port formed in the dispenser 14 while the door 12 is closed.

The coupling structure between the ice-making compartment cover 30 and the ice-making compartment 21, is constructed as follows. At one side of the ice-making compartment cover 30 is mounted a bar-type rotary lever 40*a*, which is connected to latching hooks 41*a* mounted in the ice-making compartment cover 30 such that the latching hooks 41*a* can be rotated along with the rotary lever 40*a*.

Specifically, the latching hooks 41*a* are mounted at opposite sides of the ice-making compartment cover 30 in a pair. Between the two latching hooks 41*a* is connected a rotary shaft 42, which is rotated simultaneously with the rotation of the rotary lever 40*a*.

Ends of the latching hooks 41*a* are bent. In opposite side walls of the ice-making compartment 21 are formed latching grooves 22 corresponding to the latching hooks 41*a*. In the latching grooves 22 are formed latching projections 23*a*.

While the latching hooks 41*a* are coupled with the corresponding latching projections 23*a* (which is referred to as the initial state), the end of the rotary lever 40*a* is directed downward. Consequently, the rotary lever 40*a* is approximately perpendicular to the latching hooks 41*a*.

The rotary lever 40*a* and the corresponding latching hook 41*a* may be separately manufactured and then assembled with each other. Preferably, however, the rotary lever 40*a* and the corresponding latching hook 41*a* are integrally formed as shown in the drawings in consideration of the operational relationship between the rotary lever 40*a* and the corresponding latching hook 41*a*.

The latching hooks 41*a* are elastically supported by an elastic member 43 to prevent the latching hooks 41*a* from being arbitrarily separated from the latching projections 23 without the application of an external force to the rotary lever 40*a* while the latching hooks 41*a* are coupled with the latching projections 23*a*.

In the first embodiment, the elastic member 43 is constructed in the form of a torsion spring. One end of the elastic member 43 is fixed between the rotary lever 40*a* and the corresponding latching hook 41*a*, and the other end of the elastic member 43 is fixed to the ice-making compartment cover 30.

When an external force is removed after the latching hooks 41*a* are separated from the latching projections 23*a* through the rotation of the rotary lever 40*a*, the latching hooks 41*a* are returned to the state in which the latching hooks 41*a* are coupled with the latching projections 23*a* by the elastic member 43, as shown in FIG. 3.

Figure 4:
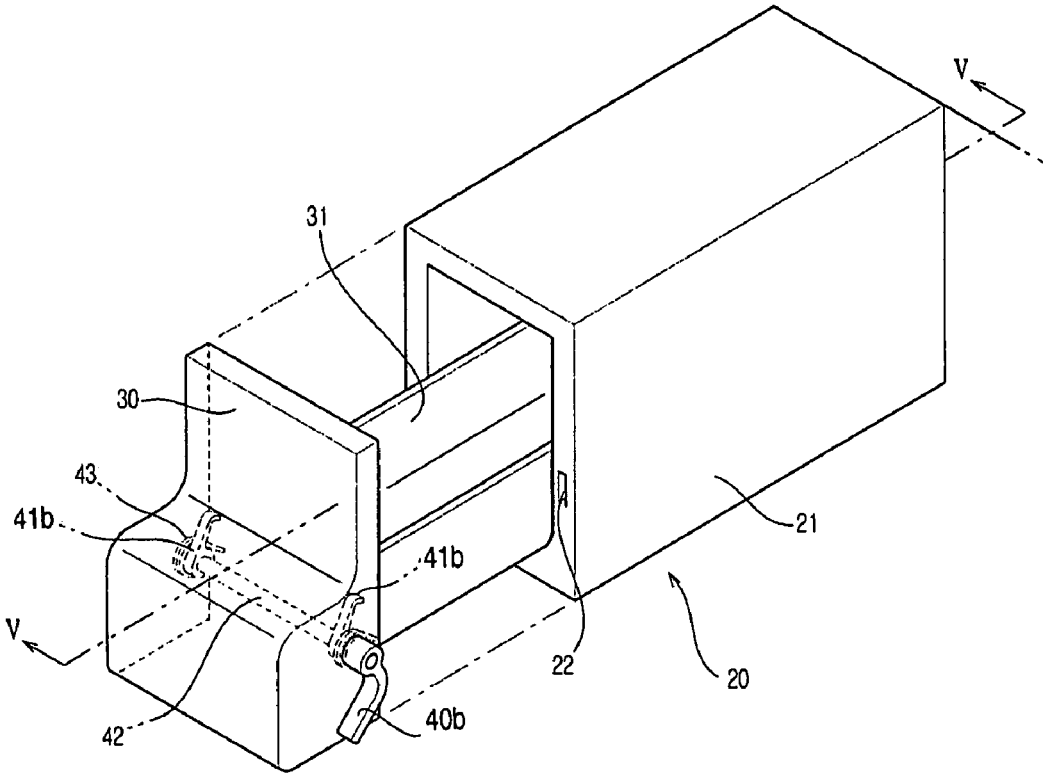
FIG. 4 is an exploded perspective view illustrating the construction of an ice-making unit according to a second embodiment of the present invention.
Figure 5:
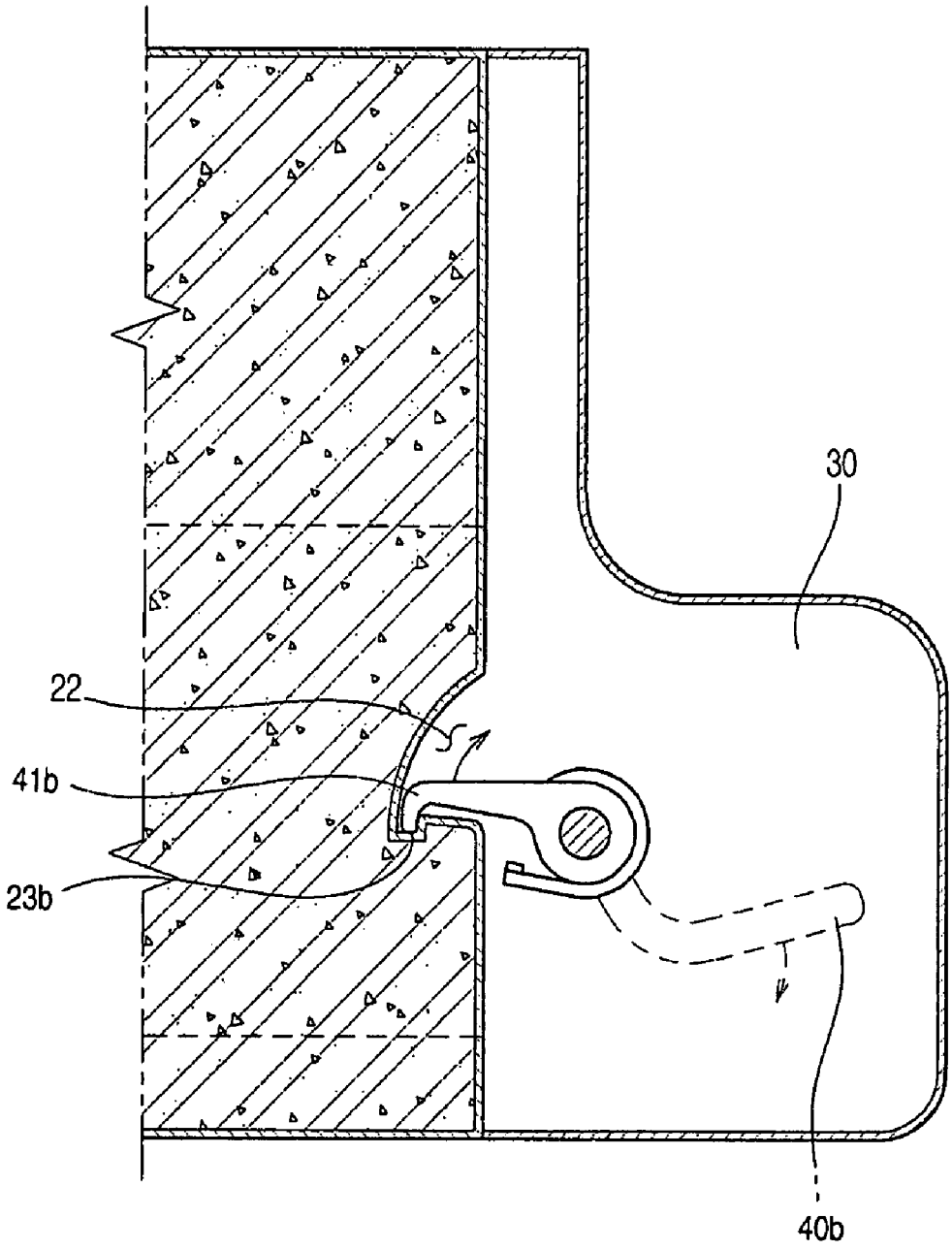
FIG. 5 is a sectional view taken along line V-V of FIG. 4.

FIGS. 4 and 5 illustrate an ice-making unit according to a second embodiment. As shown in these drawings, the end of the rotary lever 40*b* is forward while the latching hooks 41*b* are coupled with the corresponding latching projections 23*b*. As the rotary lever 40*b* is pushed rearward, the ends of the latching hooks 41*b* are rotated out from within the latching grooves 22 with the result that the latching hooks 41*b* are separated from the latching projections 23*b*.

Consequently, it is possible to rotate the rotary lever simultaneously when gripping the rotary lever 40*b* to separate the ice-making compartment cover 30 from the ice-making compartment 21. Also, when the rotary lever 40*b* is rotated by a predetermined angle, such that the latching hooks 41*b* are separated from the latching projections 23*b*, and is pulled forward, the ice-making compartment cover 30 is moved forward.

As can be seen from the two embodiments, the rotation of the rotary lever to separate the latching hooks from the latching projections may be performed in a clockwise direction or in a reverse direction. As a result, the ends of the latching hooks and the latching projections may be bent upward or downward.

The initial position of the rotary lever and the angle between the latching hooks and the rotary lever may be variously changed such that the latching hooks are separated from the latching projections by the rotation of the rotary lever, and this rotation of the rotary lever may be smoothly performed simultaneously with the pulling of the ice-making compartment cover forward to separate the ice-making compartment cover from the ice-making compartment.

As apparent from the above description, the ice-making compartment is provided at one side of the refrigerating compartment in the refrigerator according to the present embodiments, and the rotary lever, which releases the coupling between the ice-making compartment cover to open and close the open front of the ice-making compartment and the ice-making compartment, is provided at one side of the ice-making compartment cover.

Consequently, the rotation of the rotary lever is smoothly performed simultaneously with the pulling of the ice-making compartment cover forward to separate the ice-making compartment cover from the ice-making compartment, thereby improving user convenience.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a refrigerator body having a refrigerating compartment and a freezing compartment defined therein;

an ice-making compartment mounted at one side of the refrigerating compartment, the ice-making compartment having an opening formed at a front thereof;

an ice-making compartment cover to open and close the opening of the ice-making compartment and being detachably coupled to a front wall of the ice-making compartment when the ice-making compartment cover closes the opening;

a rotary lever mounted at the ice-making compartment cover;

latching hooks rotatable along with the rotation of the rotary lever, the latching hooks including a first latching hook mounted at one side of the ice-making compartment cover and a second latching hook mounted at the other side of the ice-making compartment cover;

a rotary shaft connected between the first latching hook and the second latching hook such that the rotary shaft is rotated simultaneously with the rotation of the first latching hook and the second latching hook; and latching projections defined within a front of a side wall of the ice-making compartment, the latching hooks capable of being coupled with the latching projections, wherein the ice-making compartment cover is only secured to the ice-making compartment by the latching hooks and latching projections.

2. The refrigerator according to claim 1, further comprising an elastic member mounted at the ice-making compartment cover to elastically support the rotary lever such that the latching hooks are returned in a direction in which the latching hooks are coupled with the latching projections.

3. The refrigerator according to claim 1, wherein the rotary lever and the first latching hook are integrally formed.

4. The refrigerator according to claims 1, 2 or 3, further comprising the latching hooks are separated from the latching projections by pulling the rotary lever forward.

5. The refrigerator according to claims 1, 2 or 3, further comprising the latching hooks are separated from the latching projections by pushing the rotary lever rearward.

6. A refrigerator, comprising:

an ice-making compartment mounted within a compartment of the refrigerator;

an ice-making compartment cover covering an opening of the ice-making compartment and being detachably coupled to a front wall of the ice-making compartment;

at least one latching hook attached to the cover, the at least one latching hook including a first latching hook mounted at one side of the ice-making compartment cover and a second latching hook mounted at the other side of the ice-making compartment cover;

a rotary shaft connected between the first latching hook and the second latching hook such that the rotary shaft is rotated simultaneously with the rotation of the first latching hook and the second latching hook; and at least one latching projection defined within a front of a side wall of the ice-making compartment, the at least one latching projection receiving the at least one latching hook in a latched state in which the hook is coupled to the projection, wherein the ice-making compartment cover is only secured to the ice-making compartment by the at least one latching hook and at least one latching projection.

7. The refrigerator according to claim 6, further comprising a rotary lever mounted at the ice-making compartment cover and an elastic member mounted at the ice-making compartment cover to elastically support the rotary lever such that the latching hooks are returned in a direction in which the latching hooks are coupled with the latching projections.

8. The refrigerator according to claim 6, further comprising a rotary lever mounted at the ice-making compartment cover, the rotary lever being integrally formed with the first latching hook.

9. The refrigerator according to claim 6, further comprising a rotary lever mounted at the ice-making compartment cover, wherein the at least one latching hook is separated from the at least one latching projection by pulling the rotary lever forward.

10. The refrigerator according to claim 6, further comprising a rotary lever mounted at the ice-making compartment cover, wherein the at least one latching hook is separated from the at least one latching projection by pushing the rotary lever rearward.

11. A refrigerator, comprising:

a refrigerator body having a refrigerating compartment and a freezing compartment defined therein;

an ice-making compartment mounted at one side of the refrigerating compartment, the ice-making compartment cover having an opening formed at a front thereof;

an ice-making compartment cover to open and close the opening of the ice-making compartment;

a rotary lever pivotally installed at the ice-making compartment cover;

latching hooks rotatable along with the rotation of the rotary lever, the latching hooks including a first latching hook mounted at one side of the ice-making compartment cover and a second latching hook mounted at the other side of the ice-making compartment cover;

a rotary shaft connected between the first latching hook and the second latching hook such that the rotary shaft is rotated simultaneously with the rotation of the first latching hook and the second latching hook; and latching projections defined within a front of a side wall of the ice-making compartment, the latching hooks capable of being coupled with the latching projections, wherein the ice-making compartment cover is only detachably mounted to the ice-making compartment by the latching hooks and latching projections.

12. A refrigerator, comprising:

a refrigerator body having a refrigerating compartment and a freezing compartment defined therein;

an ice-making compartment mounted at one side of the refrigerating compartment, the ice-making compartment having an opening formed at a front thereof;

an ice-making compartment cover to open and close the opening of the ice-making compartment;

a rotary lever mounted at the ice-making compartment cover;

latching hooks rotatable along with the rotation of the rotary lever, the latching hooks including a first latching hook mounted at one side of the ice-making compartment cover and a second latching hook mounted at the other side of the ice-making compartment cover;

latching projections formed in a side wall of the ice-making compartment, the latching hooks capable of being coupled with the latching projections; and a rotary shaft connected between the first latching hook and the second latching hook such that the rotary shaft is rotated simultaneously with the rotation of the first latching hook and the second latching hook, wherein the ice-making compartment cover is only secured to the ice-making compartment by the latching hooks and latching projections.

* * * * *